US009700777B2

(12) United States Patent
Dilz, Jr.

(10) Patent No.: US 9,700,777 B2
(45) Date of Patent: Jul. 11, 2017

(54) INSTRUMENTED, ANGLE-ADJUSTABLE BATTING TEE

(71) Applicant: Sports Sensors, Inc., Cincinnati, OH (US)

(72) Inventor: Albert E. Dilz, Jr., Cincinnati, OH (US)

(73) Assignee: Sports Sensor, Inc., Cincinnati, OH (US)

( * ) Notice: Subject to any disclaimer, the term of this patent is extended or adjusted under 35 U.S.C. 154(b) by 0 days.

(21) Appl. No.: 14/797,753

(22) Filed: Jul. 13, 2015

(65) Prior Publication Data

US 2017/0014698 A1 Jan. 19, 2017

(51) Int. Cl.
*A63B 69/00* (2006.01)
*A63B 24/00* (2006.01)

(52) U.S. Cl.
CPC ..... *A63B 69/0002* (2013.01); *A63B 24/0021* (2013.01); *A63B 69/0075* (2013.01); *A63B 2069/0008* (2013.01); *A63B 2208/0204* (2013.01); *A63B 2220/30* (2013.01)

(58) Field of Classification Search
CPC ..... A63B 2069/0008; A63B 69/0075; A63B 69/0091
USPC ..... 473/417
See application file for complete search history.

(56) References Cited

U.S. PATENT DOCUMENTS 3,781,879 A 12/1973 Staras et al.
3,852,743 A 12/1974 Gupta
3,895,366 A 7/1975 Morris
3,896,435 A 7/1975 Constant
4,030,097 A 6/1977 Gedeon
4,184,156 A 1/1980 Petrovsky et al.
4,276,548 A 6/1981 Lutz
4,509,052 A 4/1985 Cash
4,759,219 A 7/1988 Cobb et al.
4,801,880 A 1/1989 Koike
4,834,375 A * 5/1989 Elstein ..... A63B 24/00 273/446
4,915,384 A 4/1990 Bear
5,092,602 A 3/1992 Witler et al.
5,133,213 A 7/1992 Bernstein et al.
5,199,705 A 4/1993 Jenkins et al.
5,275,396 A * 1/1994 Sudia ..... A63B 69/0091 473/427
5,315,306 A 5/1994 Doughty et al.
5,401,026 A 3/1995 Eccher et al.
5,419,549 A 5/1995 Galloway et al.
(Continued)

*Primary Examiner* — Mark Graham
(74) *Attorney, Agent, or Firm* — Wood Herron & Evans LLP

(57) ABSTRACT

An instrumented, swing path adjustable, angle-adjustable batting tee is disclosed that measures both a bat speed and a ball exit velocity as a hitter swings a bat and initiates contact with a ball positioned on the tee. A bat speed radar detector is coupled to the tee and positioned within proximity of the ball set on the tee so that the bat speed radar detector measures the bat speed upon the bat initiating contact with the ball. A ball exit velocity radar is coupled to the tee and positioned within proximity of a ball flight of the ball as it leaves the bat so that the ball exit velocity radar measures the ball exit velocity of the ball in-flight after contact between the bat and the ball. The ball flight is a path that the ball travels after contact between the bat and a baseball or softball.

17 Claims, 3 Drawing Sheets

(56) References Cited

U.S. PATENT DOCUMENTS

| | | | | |
|---|---|---|---|---|
| 5,471,405 | A | 11/1995 | Marsh | |
| 5,553,846 | A | 9/1996 | Frye et al. | |
| 5,570,094 | A | 10/1996 | Armstrong | |
| 5,697,791 | A * | 12/1997 | Nashner | A63B 24/0003 434/247 |
| 5,723,786 | A | 3/1998 | Klapman | |
| 5,761,096 | A | 6/1998 | Zakutin | |
| 5,779,555 | A | 7/1998 | Nomura et al. | |
| 5,796,354 | A | 8/1998 | Cartabiano et al. | |
| 5,864,061 | A | 1/1999 | Dilz, Jr. | |
| 6,079,269 | A | 6/2000 | Dilz, Jr. | |
| 6,292,130 | B1 * | 9/2001 | Cavallaro | A63B 24/0021 342/104 |
| 6,378,367 | B1 | 4/2002 | Dilz, Jr. | |
| 6,666,089 | B2 | 12/2003 | Dilz, Jr. | |
| 6,898,971 | B2 | 5/2005 | Dilz, Jr. | |
| 8,007,367 | B2 | 8/2011 | Dilz, Jr. et al. | |
| 8,574,101 | B2 * | 11/2013 | Wheelbarger | A63B 69/20 473/417 |
| 2015/0065272 | A1 * | 3/2015 | Bond | A63B 69/0002 473/417 |
| 2015/0105187 | A1 * | 4/2015 | Willardson | A63B 69/0002 473/417 |

* cited by examiner

INSTRUMENTED, ANGLE-ADJUSTABLE BATTING TEE

BACKGROUND

Field of Disclosure

The present disclosure relates generally to batting tees and specifically to the measurement of bat speed and ball exit velocity in the use of batting tees.

Related Art

An increasingly popular metric in measuring the effectiveness of a baseball or softball hitter's swing is the velocity of the ball in-flight after contact with the ball with a ball bat ("ball exit velocity") with the objective to drive the ball away from the hitter. Greater ball exit velocity of the ball in-flight after contact with the bat is representative of the hitter initiating contact with the ball with a greater portion of the bat and with greater precision and is thus representative of a more effective swing associated with the hitter. Lesser ball exit velocity after contact with the bat is representative of the hitter initiating contact with the ball with a lesser portion of the bat and with lesser precision and is thus representative of a less effective swing associated with the hitter.

Conventional methods in measuring ball exit velocity include the implementation of a radar detector held by an operator in which the operator attempts to aim the radar detector at the ball after making contact with the bat and measure the ball exit velocity as the ball travels away from the bat. However, the ball exit velocity decreases rapidly during the travel of the ball after the ball initiates contact with the bat. Thus, the operator that attempts to measure the ball exit velocity of the ball as the ball travels after initiating contact with the bat measures a ball exit velocity that is decreasing as the ball travels. Such a measured ball exit velocity can be significantly less than the ball exit velocity of the ball in-flight after the ball makes contact with the bat resulting in an inaccurate assessment in the effectiveness of the hitter's swing.

Additionally, when the operator aims the radar detector at the ball after making contact with the bat, the radar detector may be at an angle relative to the travel path of the ball which skews the measurements of the ball exit velocity. Rather than measuring the ball exit velocity, an angle between the radar detector and the travel path of the ball can result in the cosine of the ball exit velocity being measured by the radar detector, particularly those operating on the Doppler principle. The cosine of the ball exit velocity can be significantly less than the actual ball exit velocity, which again results in an inaccurate assessment in the effectiveness of the hitter's swing. Since the angle can be different from measurement to measurement, it can be difficult to take the angle into account in comparing or evaluating measurements without the use of a complex and expensive radar system.

BRIEF DESCRIPTION OF THE DRAWINGS/FIGURES

Embodiments of the present disclosure are described with reference to the accompanying drawings. In the drawings, like reference numerals indicate identical or functionally similar elements. Additionally, the left most digit(s) of a reference number identifies the drawing in which the reference number first appears.

Figure 1:
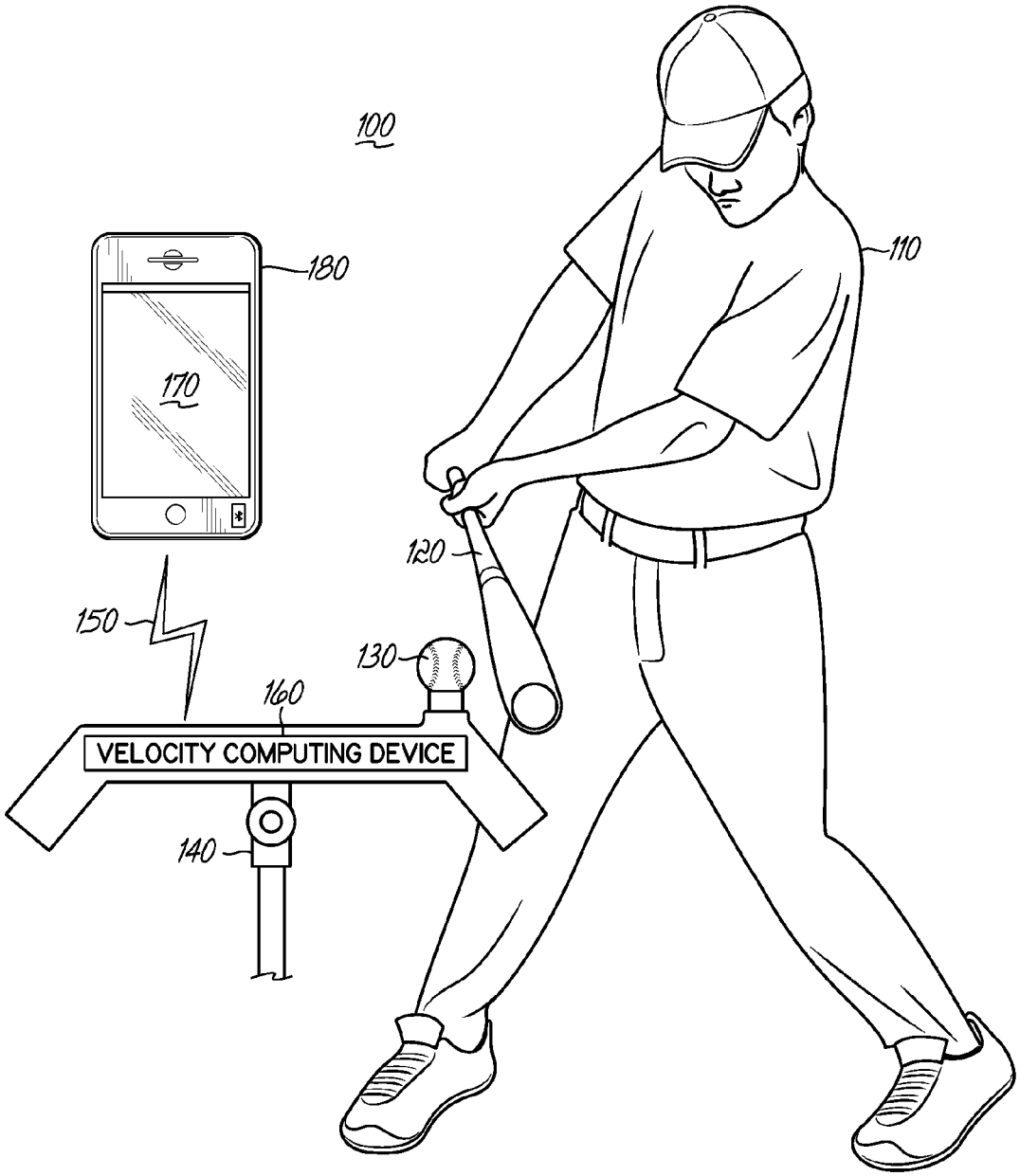
FIG. 1 illustrates an exemplary instrumented, angle-adjustable batting tee according to an exemplary embodiment of the present disclosure.

The present disclosure will now be described with reference to the accompanying drawings. In the drawings, like reference numbers generally indicate identical, functionally similar, and/or structurally similar elements. The drawings in which an element first appears is generally indicated by the leftmost digit(s) in the reference number.

DETAILED DESCRIPTION OF THE PRESENT DISCLOSURE

The following Detailed Description refers to accompanying drawings to illustrate exemplary embodiments consistent with the present disclosure. References in the Detailed Description to "one exemplary embodiment," "an exemplary embodiment," an "example exemplary embodiment," etc., indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, and it is within the knowledge of those skilled in the art(s) to affect such feature, structure, or characteristic in connection with other exemplary embodiments whether or not explicitly described, such other embodiments, so affected, are intended to be suggested and included in this description.

The exemplary embodiments described herein are provided for illustrative purposes, and are not limiting. Other exemplary embodiments are possible, and modifications may be made to the exemplary embodiments within the spirit and scope of the present disclosure. Therefore, the Detailed Description is not meant to limit the present disclosure. Rather, the scope of the present disclosure is defined only in accordance with the following claims and their equivalents.

Embodiments of the present disclosure may be implemented in hardware, firmware, software, or any combination thereof. Embodiments of the present disclosure may also be implemented as instructions supplied by a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical optical, acoustical or other forms of propagated signals (e.g., carrier waves, infrared signals, digital signals, etc.), and others. Further firmware, software routines, and instructions may be described herein as performing certain actions. However, it should be appreciated that such descriptions are merely for convenience and that such actions in fact result from computing devices, processors, controllers, or other devices executing the firmware, software, routines, instructions, etc.

For purposes of this discussion, each of the various components discussed may be considered a module, and the term "module" shall be understood to include at least one of software, firmware, and hardware (such as one or more circuit, microchip, or device, or any combination thereof), and any combination thereof. In addition, it will be understood that each module may include one, or more than one, component within an actual device, and each component that forms a part of the described module may function either cooperatively or independently of any other component forming a part of the module. Conversely, multiple modules described herein may represent a single component within an actual device. Further, components within a module may be in a single device or distributed among multiple devices in a wired or wireless manner.

The following Detailed Description of the exemplary embodiments will so fully reveal the general nature of the present disclosure that others can, by applying knowledge of those skilled in the relevant art(s), readily modify and/or adapt for various applications such exemplary embodiments, without undue experimentation, without departing from the spirit and scope of the present disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

An Exemplary Instrumented, Angle-Adjustable Batting Tee

FIG. 1 illustrates an exemplary instrumented, angle-adjustable batting tee according to an exemplary embodiment of the present disclosure used by a ball player to practice hitting a baseball or softball. An instrumented, angle-adjustable batting tee configuration 100 may measure both ball exit velocity and bat speed, and then display both the ball exit velocity and the bat speed measurements to the hitter. For example, a velocity measuring device 160 or other speed measuring device may be included in a batting tee configuration 140 and measure both the bat speed, which is the velocity of the bat 120 as the bat 120 makes initial contact with the ball 130 and the ball exit speed, which is the velocity of a ball 130 in-flight as the hitter 110 has completed contact of the ball 130 with the bat 120. The bat speed and the ball exit velocity are then both displayed by a communications device 180 via display 170.

The batting tee configuration 140 includes a stationary tee which the hitter 110 adjusts so that the hitter 110 may position the ball 130 in a stationary position on the batting tee configuration 140 and then swing the bat 120 into the ball 130 to practice, teach, correct and/or reinforce the mechanics of the swing of the hitter 110. The batting tee configuration 140 may be positioned on the ground as well as adjusted to a desired height such that the batting tee configuration 140 simulates the various locations of a pitched ball 130 from a pitcher as seen by the hitter 110. The batting tee configuration 140 may be adjusted for both a left-handed hitter and a right-handed hitter. For example, the hitter 110 may position the batting tee configuration 140 to a desired position and height so that the ball 130 is positioned for a left-handed hitter in the middle of the hitting zone of the hitter 110 so that the hitter may practice hitting the ball 130 up through the middle of the ball field. The hitter 110, after each swing, positions the ball 130 once again on the batting tee configuration 130 and then repetitiously continues to hit the ball 130 up through the middle of the ball field, thereby perfecting the mechanics of such a swing.

A primary purpose of the batting tee configuration 140 is to provide feedback to the hitter 110 as to the quality of each swing so that the hitter's swing may be continually improved based on the feedback. For example, visual feedback is generated each time the hitter 110 completes the swing. The visual feedback is generated from the travel path of the ball 130 after the hitter initiates contact with the ball 130 via the bat 120. The hitter 110 may be able to observe the quality of the swing based on whether the travel path of the ball 130 satisfied the expectations of the hitter 110. The hitter 110 may then affirmatively determine the mechanics of the hitter 110 were sufficient when the travel path of the ball 130 satisfies the expectations of the hitter 110 or negatively determine that the mechanics were insufficient when the travel path fails to satisfy the expectations of the hitter.

Rather than simply providing visual feedback to the hitter 110, the batting tee configuration 140 may also provide additional parameters to the hitter 110 that also provide feedback to the hitter 110 with regards to the quality of the swing executed by the hitter 110. Bat speed and ball exit velocity may be additional parameters measured by the batting tee configuration that can provide feedback to the hitter 110 with regards to the quality of the swing of the hitter 110.

Bat speed is the velocity of the bat 120 that is achieved as the hitter 110 initiates the swing of the bat 120 from a rest position and then thrusts the bat 120 through the hitting zone to when the bat 120 makes initial contact with the ball 130 with the desire to drive the ball 130 away from the hitter 110. The velocity of the bat immediately upon initiating contact with the ball has a direct effect on the ball exit velocity as well as the distance that the ball 130 will travel after the hitter 110 makes contact with the ball 130. The greater the ball exit velocity and the greater the distance are indicative of a high quality swing executed by the hitter 110. Thus, the greater the bat speed, the greater the likelihood that the hitter 110 will make contact with the ball 130 such that the ball 130 shoots off the bat 120 with significant ball exit velocity and/or travels a distance representative of a high quality swing executed by the hitter 110.

Ball exit velocity is the exit velocity of the ball 130 in-flight immediately upon leaving the bat 120 after the hitter 110 makes contact with the ball 130 with the bat 120. The ball exit velocity may be an indication of not only bat speed as discussed above but also of the precision in which the hitter 110 initiates contact with the ball 130. The ball exit velocity may be an indication of how positively the bat 120 transfers the energy generated from the bat speed into the ball exit velocity. For example, the ball exit velocity is an indication of how much of the surface area of the bat 120 made contact with the ball 130, the location on the ball 130 where the contact was made, and also how well the hitter 110 then drove through the ball 130 after making contact with the ball 130 via the bat 120.

The velocity measuring device 160 may measure both the bat speed as well as the ball exit velocity as the hitter 110 executes a swing of the bat 120 and initiates contact with the ball 130. The velocity measuring device 160 may include one or more radar detectors that are capable of measuring the bat speed and the ball exit velocity associated with the swing of the hitter 110. The one or more radar detectors include sensors capable of detecting Doppler, piezo, visual average speed computer and recorder (VASCAR), light detection and ranging (LIDAR), and/or any other type of velocity detecting capability that will be apparent to those skilled in the relevant art(s) without departing from the spirit and scope of the disclosure.

In an embodiment with a single radar detector, the single radar detector may measure both the bat speed and the ball exit velocity, with the velocity measuring device 160 determining the bat speed and the ball exit velocity from the measurements captured by the single radar detector. In another embodiment, a first radar detector measures the bat speed and a second radar detector measures the ball exit velocity by measuring the velocity of the ball in flight in sufficiently close proximity to the point at which the ball has completed contact with the bat that the ball velocity has not significantly decreased from the maximum ball exit velocity. The velocity measuring device 160 then determines the bat speed from the measurements captured by the first radar detector and the ball exit velocity from the measurements captured by the second radar detector. In another embodiment, several radar detectors measure the bat speed and several other radar detectors measure the ball exit velocity. In another embodiment, several radar detectors measure both the bat speed and the ball exit velocity.

The hitter 110 initiates the swing of the bat 120 from an initiating position in which the initial velocity of the bat 120 is 0.0 mph and then quickly increases the velocity as the hitter 110 thrusts the bat 120 through the hitting zone toward the ball 130 positioned on the batting tee configuration 140. The one or more radar detectors positioned in the velocity measuring device 160 then measure the bat speed of the bat 120 as the bat 120 initiates contact with the ball 130 as well as measure the ball exit velocity in-flight after the bat 120 contacts the ball 130.

The velocity measuring device 160 may then determine the bat speed and the ball exit velocity so that the bat speed and the ball exit velocity provide adequate feedback to the hitter 110 so that the hitter 110 may assess the quality of the swing as executed by the hitter 110. Greater bat speed and greater ball exit velocity may indicate a higher quality swing executed by the hitter 110. A greater bat speed provides the hitter 110 a higher probability that the hitter 110 will strike the ball 130 so as to result in a higher ball exit velocity, thereby resulting in the hitter 110 driving the ball 130 a satisfactory distance. Both high bat speed and high ball exit velocity can be indicative of a high quality swing executed by the hitter 110. Greater the ball exit velocity 110 is indicative of a hitter 110 initiating contact with the ball 130 with precision so that a significant portion of the bat 120 made contact with the ball 130, which is also indicative of a high quality swing executed by the hitter 110.

The positioning of the velocity measuring device 160 as coupled to the batting tee configuration 140 enables the one or more radar detectors positioned in the velocity measuring device 160 to measure the ball exit velocity of the ball 130 in-flight after the bat 120 initiates contact with the ball 130. The measuring of the ball exit velocity of the ball 130 in-flight after the bat 120 initiates contact with the ball 130 by the one or more radar detectors coupled to the batting tee configuration 140 significantly eliminates any decrease in the ball exit velocity as the ball 130 travels away from the hitter 110.

As mentioned above, the velocity of the ball 130 significantly decreases as the ball travels away from the hitter 110 so any measurements of the ball exit velocity after the ball 130 travels away from the hitter 110 results in a decreased ball exit velocity measurement as compared to the ball exit velocity of the ball 130 in-flight following contact with the bat 120. A decreased ball exit velocity resulting from measurements of the ball exit velocity after the bat 120 has contacted the ball 130 may be the result of the ball exit velocity simply decreasing as the ball 130 travels rather than a poor swing executed by the hitter 110. Thus, the positioning of the one or more radar detectors as coupled to the batting tee configuration 140 so that the one or more radar detectors measure the ball exit velocity of the ball 130 in-flight near the beginning of its flight path after the bat 120 has completed contacting the ball 130 to provide a more accurate assessment of the swing executed by the hitter 110. The velocity measuring device 160 may measure the bat speed alone, the ball exit velocity alone, or both the bat speed and the ball exit velocity during the execution of the same swing of the bat 120.

The velocity measuring device 160 may then transmit the measured bat speed and the ball exit velocity to the communications device 180 via the velocity signal 150. The communications device 180 may then display the measured bat speed and the ball exit velocity to the hitter 110 via the display 170. The communications device 180 may be a device that is capable of electronically communicating with other devices while having the display 170. Examples of the communications device 180 may include a mobile phone, a smartphone, a workstation, a portable computing device, other computing devices such as a laptop, a tablet, or a desktop computer, cluster of computers, a computer peripheral such as a printer, a portable audio, and/or video player and/or any other suitable electronic device with the display 170 that will be apparent to those skilled in the relevant art(s) without departing from the spirit and scope of the disclosure. The display 170 may include any type of display device including but not limited to a touch screen display, a cathode ray tube (CRT) monitor, a liquid crystal display (LCD) screen, and/or any other type of device that includes a display that will be apparent from those skilled in the relevant art(s) without departing from the spirit and scope of the present disclosure.

The velocity measuring device 160 transmits both the bat speed and the ball exit velocity to the communications device 180 via the velocity signal 150. The communications device 180 displays both the bat speed and the ball exit velocity to the hitter 110 simultaneously via the display 170. The hitter 110 may then easily obtain feedback with regards to the execution of the swing based on the immediate display of the bat speed and the ball exit velocity by the communications device 180 via the display 170. After the hitter 110 has observed the flight of the ball 130 and assessed the swing based on the flight of the ball 130, the hitter 110 may then complement that visual feedback of the flight of the ball 130 with the bat speed and the ball exit velocity simultaneously displayed by the display 170.

For example, the hitter 110 observes that the ball 130 shot in the direction that the hitter 110 had desired to hit the ball 130 based on the positioning of the batting tee configuration 140 relative to the hitter as well as the travel path of the ball 130 followed a line drive path. Such visual feedback indicates that the hitter 110 executed a high quality swing. The hitter 110 may then complement that visual feedback by viewing the bat speed and the ball exit velocity of the executed swing as displayed by the display 170. A high bat speed and a high ball exit velocity reinforce the assessment of the swing by the hitter 110 as being a high quality swing.

In an embodiment, the display 170 may be a single display that either sequentially or simultaneously displays the bat speed and the ball exit velocity. For example, the display 170 may first display the bat speed and then display the ball exit velocity. In another embodiment, the display 170 may first display the ball exit velocity and then display the bat speed. In another embodiment, the display 170 may include two distinct displays that either sequentially or simultaneously display the bat speed and the ball exit velocity. For example, a first display displays the ball exit velocity and then a second display displays the bat speed. In another example, the first display displays the bat speed and then the second display displays the ball exit velocity. In another example, the first display displays the bat speed and the second display displays the ball exit velocity simultaneously. The display 170 may display the bat speed and the ball exit velocity in any manner so that the hitter 110 may easily read the bat speed and the ball exit velocity from the display 170 that will be apparent from those skilled in the relevant art(s) without departing from the spirit and scope of the present disclosure. The velocity signal 150 may be transmitted from the velocity measuring device 160 to the communications device 180 via Bluetooth, Wi-Fi, cellular, and/or any other acceptable radio frequency data transmissions and reception techniques that will be apparent to those skilled in the relevant art(s) without departing from the spirit and scope of the disclosure.

An Exemplary Instrumented, Angle-Adjustable Batting Tee Configuration

Figure 2:
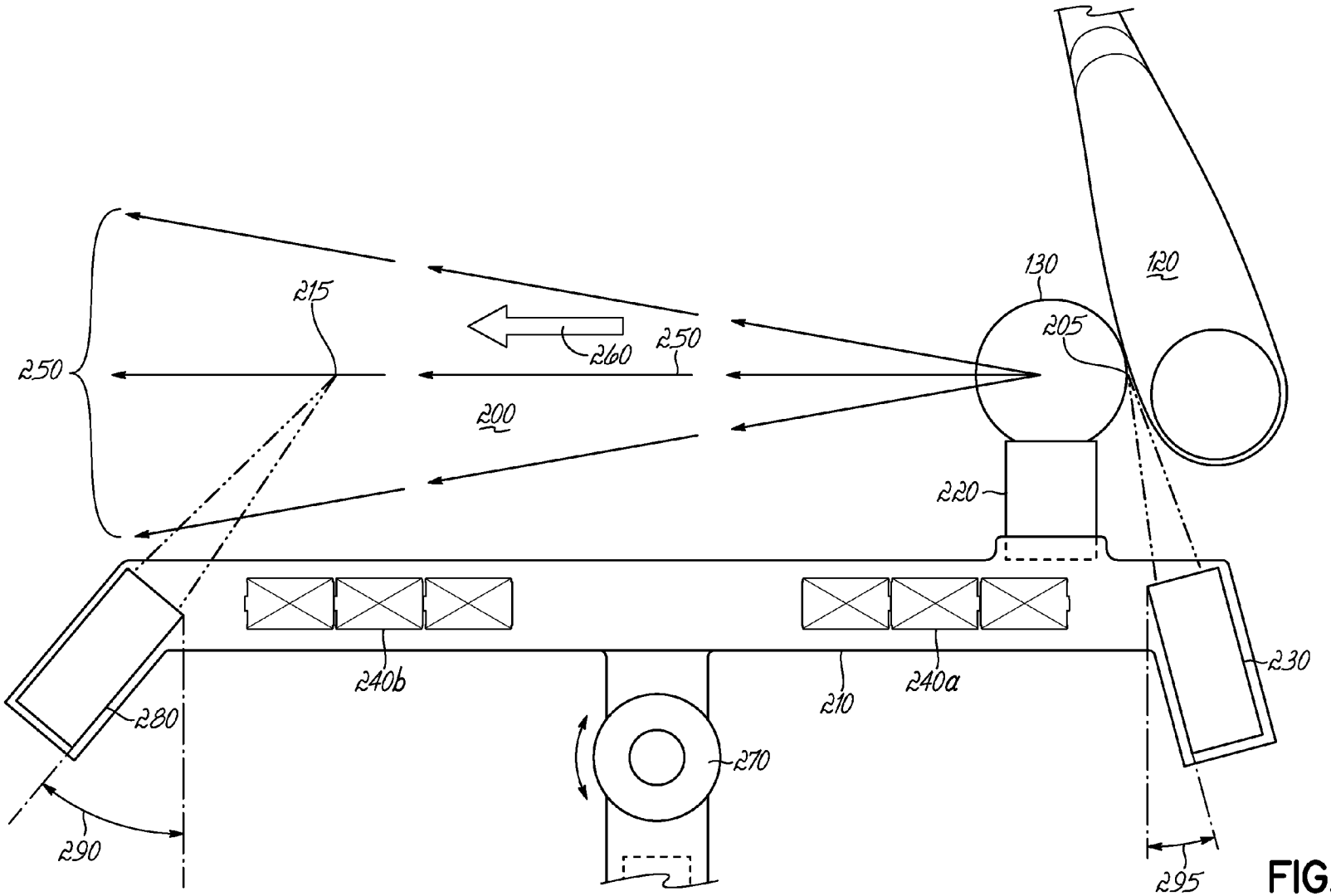
FIG. 2 illustrates a block diagram of an instrumented, angle-adjustable batting tee configuration according to an exemplary embodiment of the present disclosure.

FIG. 2 illustrates a block diagram of an instrumented, angle-adjustable batting tee configuration according to an exemplary embodiment of the present disclosure. The instrumented, angle-adjustable batting tee configuration 200 includes two radar detectors. A first radar represented by a bat speed radar 230 measures the bat speed of the bat 120 as the bat 120 initiates contact with the ball 130. A second radar represented by a ball exit velocity radar 280 measures the ball exit velocity of the ball 130 after the bat 120 has contacted with the ball 130. The ball exit velocity radar 280 is positioned a distance from where the ball 130 is positioned on a flexible ball rest 220 such that the distance is adequate to prevent the ball exit velocity radar 280 from detecting the bat 120 as the bat 120 comes through the hitting zone and after contact with the ball 130. The distance is also adequate such that the ball exit velocity radar 280 measures the ball exit velocity from the in-flight velocity of the ball 130 before the ball velocity begins to decrease due to the flight of the ball 130.

The instrumented, angle-adjustable batting tee configuration 200 also includes an adjustable swing angle adapter 270, a bat radar power supply 240*a*, a ball radar power supply 240*b*, a ball exit velocity vector 250, a ball flight path 260, a bat velocity radar angle 295 and a ball exit velocity radar angle 290.

The hitter 110 may position the ball 130 on the flexible ball rest 220 before initiating a swing with the bat 120 to hit the ball 130. The hitter 110 may be a right-handed hitter or a left-handed hitter. The flexible ball rest 220 may include a flexible material such that when the hitter 110 executes the swing of the bat 120, any contact between the bat 120 and the flexible ball rest 220 may be absorbed by the flexible ball rest 220 so that minimal friction is generated between the bat 120 and the flexible ball rest 220. The generating of minimal friction between the flexible ball rest 220 and the bat 120 may minimize the amount of deceleration of the bat 120 as the hitter 110 executes the swing in attempting to hit the ball 130 with the bat 120. The flexible ball rest 220 may be removable and/or replaceable such that the flexible ball rest 220 may be easily replaced with additional flexible ball rests after the flexible ball rest 220 is no longer in a condition to adequately support the ball 130.

The bat velocity radar 230 may be positioned below the flexible ball rest 220 and coupled to the instrumented, angle-adjustable batting tee configuration 200. The bat velocity radar 230 may be positioned such that a velocity detector portion of the bat velocity radar 230 is facing upwards towards the flexible ball rest 220 and aimed to where the ball 130 is positioned on the flexible ball rest 220. The bat velocity radar 230 may be positioned within proximity of the ball 130 positioned on the flexible ball rest 220 such that the bat velocity radar 230 may adequately detect the bat 120 as the bat 120 initiates contact with the ball 130 and may adequately measure the bat speed of the bat 120. The bat velocity radar 230 is not positioned within proximity of the ball 130 positioned on the flexible ball rest 220 when the bat velocity radar 230 fails to adequately measure the bat speed of the bat 120 as the bat 120 initiates contact with the ball 130.

After the hitter 110 contacts the ball 130 via the bat 120, the ball 130 engages in the ball flight 260. The ball flight 260 is the flight of the ball 130 after the hitter 110 executes the swing and the ball 130 takes off along the ball flight 260 at the ball exit velocity. The ball exit velocity radar 280 is positioned a distance from the flexible ball rest 220 and in the line with the ball flight 260. The ball exit velocity radar 280 is also positioned a distance from the flexible ball rest 220 such that the ball exit velocity radar is a sufficient distance away from the flexible ball rest 220 to not detect the bat 120 travelling through the hitting zone as the hitter 110 executes the swing and initiates contact with the ball 130 via the bat 120.

Any detection of the bat 120 travelling at the bat speed by the ball exit velocity radar 280 may skew the measurement of the ball exit velocity. The ball exit velocity radar 280 may have difficulty distinguishing the ball exit velocity of the ball 130 as the ball 130 travels along the ball flight 260 from the bat speed of the bat 120 as the bat 120 travels through the hitting zone if the ball exit velocity radar 280 were to detect the bat 120. Thus, positioning of the ball exit velocity radar 280 a sufficient distance away from the flexible ball rest 220 removes any impact that the bat 120 may have on the measuring of the ball exit velocity of the ball 130 by the ball exit velocity radar 280.

The ball exit velocity radar 280 may also be positioned a sufficient distance to the flexible ball rest 220 such that when the ball 130 travels along the ball flight 260 so that the ball exit velocity radar 280 measures the ball exit velocity, the ball exit velocity has not begun to decrease due to the ball 130 travelling along the ball flight 260. As mentioned above, the ball exit velocity of the ball 130 may decrease as the ball travels along the ball flight 260. As a result, the ball exit velocity radar detector 280 may be positioned a distance that is sufficiently close to the flexible ball rest 220 such that the ball exit velocity radar detector 280 measures the ball exit velocity of the ball 130 in-flight after contact with the bat 120 before the ball exit velocity of the ball 130 decreases. The positioning of the ball exit velocity radar detector 280 so that it measures ball velocity in flight while still approximately over the batting tee configuration, for example, will typically measure ball exit velocity with sufficient accuracy.

The ball exit velocity radar 280 may be positioned below the ball flight 260 of the ball 130 and coupled to the instrumented, angle-adjustable batting tee configuration 200. The ball exit velocity radar 280 may be positioned such that a velocity detector portion of the ball exit velocity radar 280 is facing upwards and aimed towards the ball flight 260 of the ball 130. The ball exit velocity radar 280 may be positioned within proximity of the ball flight 260 of the ball 130 such that the ball exit velocity radar 280 may adequately detect the ball 130 as the ball 130 travels along the ball flight 260 and may adequately measure the ball exit velocity of the ball 130. The velocity measuring device 160 is calibrated to accurately report the ball exit velocity in response to the signal from the ball exit velocity radar 280, positioned as described above.

In an embodiment, the bat speed radar 230 may be positioned at or below the swing plane of the hitter 110. The swing plane of the hitter 110 is the path that the bat 120 travels as the hitter 110 initiates the swing from an initial position and then travels to the ball 130 positioned on the flexible ball rest 220 and then travels along the follow through of the swing after the hitter 110 initiates contact with the ball 130. The bat speed radar 230 may be positioned at the bat angle 295 that is relative to the swing plane of the hitter 110 such that the bat speed radar 230 will produce a measurement that is representative of the speed of the bat 120 as it initiates contact with the ball 130. The velocity measuring device 160 is calibrated to accurately report the ball exit velocity in response to the signal from the bat speed radar 230, positioned as described above.

In an embodiment, the ball exit velocity radar 280 may be positioned at a ball angle 290 relative to a ball exit velocity vector 250 associated with the ball flight 260 of the ball 130. The ball exit velocity vector 250 is the velocity vector of the ball 130 after the bat 120 initiates contact with the ball 130 in which the direction of the velocity vector corresponds to the ball flight 260 of the ball 130. The ball exit velocity radar 280 may be positioned at the ball angle 290 that is relative to the ball exit velocity vector 250 such that the ball exit velocity radar 280 may be aligned with a ball flight location 215 of the ball flight 260 where the ball exit velocity vector 250 is captured by the ball exit velocity radar 280 as the ball 130 travels past the ball exit velocity radar 280.

In an embodiment, the bat speed radar 230 may be powered by the bat radar power supply 240*a* and the ball exit velocity radar 280 may be powered by the ball radar power supply 240*b*. In that way the separate radar detectors 230 and 280 are electrically independent. In another embodiment, the bat speed radar 230 and the ball exit velocity radar 280 may be powered by a single power supply. The bat radar power supply 240*a* and the ball radar power supply 240*b* may include alkaline batteries, such as one or more C-batteries. However, this example is not limiting, those skilled in the relevant art(s) may implement the bat radar power supply 240*a* and the ball radar power supply 240*b* using any other power supply and/or other battery chemistries without departing from the scope and the spirit of the present disclosure. The one or more cells of the bat radar power supply 240*a* and the ball radar power supply 240*b* may convert chemical energy into electrical energy via an electrochemical reaction.

In an embodiment, an adjustable swing angle adapter 270 may adjust the instrumented, angle-adjustable batting tee configuration 200 to an angle such that the flexible ball rest 220 may be adjusted to a corresponding angle. The adjustment of the flexible ball rest 220 to the angle results in the ball 130 being positioned at the angle as well so that the ball 130 may be positioned in the swing plane of the hitter 110 at the angle of the instrumented, angle-adjustable batting tee configuration 200. The swing plane of the hitter 110 may not necessarily be parallel to the ground as the bat 120 initiates contact with the ball 130 positioned on the flexible ball rest 220. Rather, the swing plane may be at an angle relative to the ground.

Positioning the batting tee configuration 100 such that the flexible ball rest 220 is perpendicular to the ground may require that the swing plane be parallel to the ground when the bat 120 initiates contact with a ball 130 that is placed on the ball rest 220 in order to maximize the amount of surface area of the bat 120 that engages the surface area of the ball 130. Maximizing the amount of surface area of the bat 120 that engages the surface area of the ball 130 transfers the greatest amount of energy generated by the bat speed of the bat 120 into the ball 130 resulting in greater ball exit velocity after the bat 120 initiates contact with the ball 130.

Furthermore, a hitter 110 with a swing plane at an angle such that the bat 120 is not parallel to the ground when initiating contact with the ball 130 but is rather at an angle relative to the ground may result in a inaccurate velocity measurement when measured by a radar unit positioned to measure motion parallel to the ground. To accommodate a swing plane that is not parallel to the ground, the angle adjustable tee configuration is adjusted to an angle that is parallel to the swing plane of the batter.

The adjustable swing angle adapter 270 may adjust the angle of the instrumented, angle-adjustable batting tee configuration 200 such that the flexible ball rest 220 is at an angle that is similar to the angle of the swing plane of the hitter 110.

In an embodiment, the adjustable swing adapter 270 may display the angle in which the instrumented, angle-adjustable batting tee configuration 200 has been adjusted. The instrumented, angle-adjustable batting tee configuration 200 may be locked at the selected angle setting. A lower power light emitting diode (LED) flashlight may be built into the instrumented, angle-adjustable batting tee configuration 200 for use with an external grid. The LED-illuminated grid may show the elevation and azimuth angle of the tee setting and also the location of the ball 130 after initiating contact with the bat 120 relative to the angle setting of the adjustable swing adapter 270.

Figure 3:
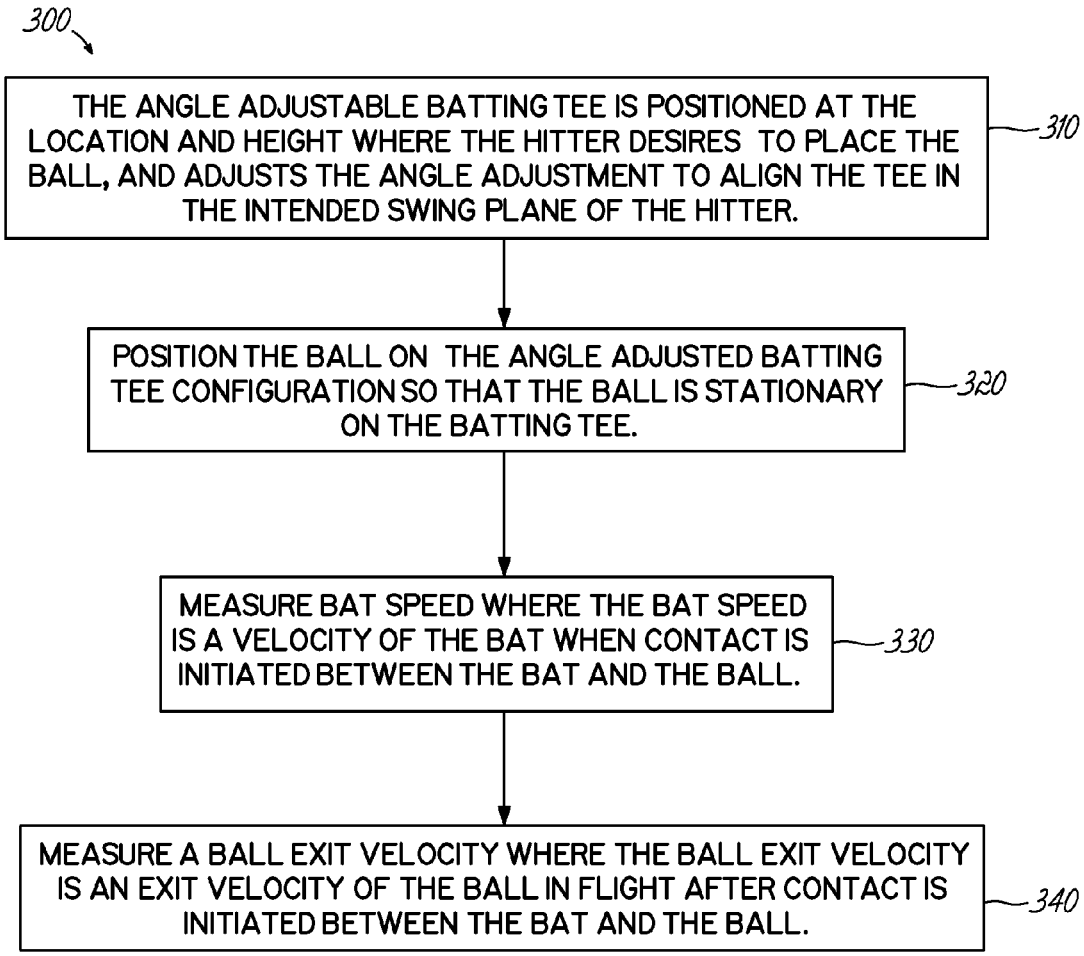
FIG. 3 is a flowchart of exemplary operational steps of the instrumented, angle-adjustable batting tee according to an exemplary embodiment of the present disclosure.

An Exemplary Operational Control Flow of the Instrumented, Angle-Adjustable Batting Tee FIG. 3 is a flowchart of exemplary operational steps of the instrumented, angle-adjustable batting tee according to an exemplary embodiment of the present disclosure. The present disclosure is not limited to this operational description. Rather, it will be apparent to persons skilled in the relevant art(s) from the teaching herein that other operational control flows are within the scope and spirit of the present disclosure. The following discussion describes the steps in FIG. 3.

At step 310, the angle adjusted batting tee 100 is positioned at the location and height where the hitter desires to place the ball, and adjusts the angle adjustment 270 to align the tee 100 in the intended swing plane of the hitter 110.

At step 320, the operational control flow positions the ball on a batting tee configuration so that the ball is stationary on the batting tee configuration.

At step 330, the operational control flow measures a bat speed where the bat speed is a velocity of a bat when contact is initiated between the bat and the ball. For example, a bat velocity radar 230 is coupled to the batting tee configuration 210 and positioned within proximity of the ball 130 positioned on the batting tee configuration 210. The bat velocity radar 230 is within proximity of the ball 130 when the bat velocity radar 230 adequately measures the bat speed of the bat 120 when contact is initiated between the bat 120 and the ball 130.

At step 340, the operational control flow measures a ball exit velocity where the ball exit velocity is an exit velocity of the ball in-flight after contact is initiated between the bat and the ball. For example, a ball exit velocity radar 280 is coupled to the batting tee configuration 210 and positioned within proximity of a ball flight 260 of the ball 130. The ball flight 260 is a path that the ball 130 travels after contact is initiated between the bat 120 and the ball 130. The ball exit velocity radar 280 is within proximity of the ball 130 when the ball exit velocity radar 230 adequately measures the ball exit velocity of the bat 120 when the ball 130 travels along the ball flight 260 after contact is initiated between the bat 120 and the ball 130.

CONCLUSION

It is to be appreciated that the Detailed Description section, and not the Abstract section, is intended to be used to interpret the claims. The Abstract section may set forth one or more, but not all exemplary embodiments, of the present disclosure, and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

It will be apparent to those skilled in the relevant art(s) that various changes in form and detail can be made without departing from the spirit and scope of the present disclosure. Thus the present disclosure should not be limited by any of the above-described exemplary embodiments, but should be defined only in accordance with the following claims and their equivalents.

What is claimed is:

1. An instrumented, angle-adjustable batting tee, comprising:

a batting tee configuration including a first end and a second end with the first end positioned opposite the second end on the batting tee configuration and positioned closer to a hitter than the second end and configured to hold a ball positioned on the first end of the batting tee configuration, wherein the first end is aligned with the second end;

a bat speed radar coupled to the first end of the batting tee configuration and positioned within proximity of the ball positioned on the first end of the batting tee configuration below a swing plane of the hitter and fixed at a bat angle that is aligned with the swing plane of the hitter and configured to measure the bat speed of a bat when contact is initiated between the bat and the ball, wherein the bat speed is a velocity of the bat when contact is initiated between the bat and the ball;

a ball exit velocity radar coupled to the second end of the batting tee configuration that is aligned with the bat speed radar coupled to the first end of the batting tee configuration and fixed at a ball angle that is aligned with a ball exit velocity vector of the ball that is associated with a ball flight of the ball after contact between the bat and the ball and is positioned below the ball flight of the ball a distance from the ball positioned on the first end of the batting tee configuration and configured to measure the ball exit velocity of the ball after contact between the bat and the ball before the ball exit velocity decreases when travelling along the ball flight and does not detect the bat as the bat travels through the ball flight, wherein the ball exit velocity is an exit velocity of the ball early in-flight after contact between the bat and the ball; and an adjustable swing adapter coupled to the batting tee configuration and is configured to adjust the batting tee configuration at an angle that corresponds to an angle of the swing plane of the hitter so that the bat angle of the bat speed radar is aligned with the swing plane of the hitter that is parallel with the angle of the batting tee configuration to measure the bat speed of the bat;

wherein the bat speed radar and the ball exit velocity radar are configured to measure both the bat speed and the ball exit velocity that result from a single swing of the bat in an attempt by the hitter to initiate contact with the ball by the bat as the ball travels along the ball flight that is aligned with the bat speed radar coupled to the first end of the batting tee configuration and the ball exit velocity radar coupled to the second end of the batting tee configuration.

2. The instrumented, angle adjusted batting tee of claim 1, wherein the velocity measuring devices are further configured to transmit the measured bat speed and the ball exit velocity to a display so that the measured bat speed and the ball exit velocity are displayed simultaneously by the display.

3. The instrumented, angle adjusted batting tee of claim 2, wherein the velocity measuring devices are further configured to transmit the measured bat speed and the ball exit velocity to the display so that the measured bat speed and the ball exit velocity are displayed simultaneously by the display.

4. The instrumented, angle adjusted batting tee of claim 2, wherein the velocity measuring devices are further configured to transmit the measured bat speed and the ball exit velocity to the display so the measured bat speed and the ball exit velocity are displayed sequentially by the display.

5. The instrumented, angle adjusted batting tee of claim 1, further comprising:

the adjustable swing angle adapter coupled to the batting tee configuration and configured to adjust the batting tee configuration at an angle that corresponds to an angle of the swing plane so that the ball is positioned in the swing plane and at the angle of the swing plane.

6. The instrumented, angle-adjustable batting tee configuration of claim 1, wherein the bat speed radar includes a Doppler radar and the ball exit velocity radar includes a Doppler radar.

7. A method for measuring a bat speed and a ball exit velocity associated with a hitter initiating contact with a ball positioned on a batting tee, comprising:

positioning the ball on a batting tee configuration including a first end and a second end with the first end positioned opposite the second end on the batting tee configuration and positioned closer to a hitter than the second end so that the ball is stationary on the first end of the batting tee configuration, wherein the first end is aligned with the second end;

positioning a bat speed radar coupled to the first end of the batting tee configuration within proximity of the ball positioned on the first end of the batting tee configuration below a swing plane of the hitter and fixed at a bat angle that is aligned with the swing plane of the hitter;

measuring, by the bat speed radar a bat speed of a bat when contact is initiated between the bat and the ball, wherein the bat speed is a velocity of a bat when contact is initiated between the bat and the ball;

positioning a ball exit velocity radar coupled to the second end of the batting tee configuration that is aligned with the bat speed radar coupled to the first end of the batting tee configuration and fixed at a ball angle that is aligned with a ball exit velocity vector of the ball that is associated with a ball flight of the ball after contact between the bat and the ball and is positioned below the ball flight a distance from the ball positioned on the first end of the batting tee configuration;

measuring, by the ball exit velocity radar a ball exit velocity of the ball after contact between the bat and before the ball exit velocity decreases when travelling along the ball flight and does not detect the bat as the bat travels through the ball flight, wherein the ball exit velocity is an exit velocity of the ball after contact between the bat and the ball;

adjusting, by an adjustable swing adapter, the batting tee configuration at an angle that corresponds to an angle of the swing plane of the hitter so that the bat angle of the bat speed radar is aligned with the swing plane of the hitter that is parallel with the angle of the batting tee configuration to measure the bat speed of the bat via an adjustable swing adapter coupled to the batting tee configuration; and measuring, by the bat speed radar and the ball exit velocity radar, both the bat speed and the ball exit velocity that result from a single swing of the bat in an attempt by the hitter to initiate contact with the ball by the bat as the ball travels along the ball flight that is aligned with the bat speed radar coupled to the first end of the batting tee configuration and the ball exit velocity radar coupled to the second end of the batting tee configuration.

8. The method of claim 7, further comprising:

transmitting, by the velocity measuring devices, the measured bat speed and the ball exit velocity to a display so that the measured bat speed and the ball exit velocity are displayed simultaneously or sequentially by the display.

9. The method of claim 8, further comprising:

transmitting, by the velocity measuring devices, the measured bat speed and the ball exit velocity to the display so that the measured bat speed and the ball exit velocity are displayed simultaneously by the display.

10. The method of claim 8, further comprising:

transmitting, by the velocity measuring devices, the measured bat speed and the ball exit velocity to the display so that the measured bat speed and the ball exit velocity are displayed sequentially by the display.

11. The method of claim 7, further comprising:

adjusting, by the adjustable swing angle adapter, the batting tee configuration at an angle that corresponds to an angle of the swing plane so that the ball is positioned in the swing plane at the angle of the swing plane.

12. The method of claim 7, wherein the bat speed radar includes a Doppler Radar and the ball exit velocity radar includes a Doppler radar.

13. An instrumented, angle-adjustable batting tee configuration, comprising:

a batting tee configuration including a first end and a second end with the first end positioned opposite the second end on the batting tee configuration and positioned closer to a hitter than the second end on the batting tee configuration and is configured to hold a ball positioned on the batting tee configuration, wherein the first end is aligned with the second end;

a bat speed radar coupled to the first end of the batting tee configuration and positioned within proximity of the ball positioned on the first end of the batting tee configuration below a swing plane of the hitter and fixed at a bat angle that is aligned with the swing plane of the hitter and configured to measure the bat speed of a bat when contact is initiated between the bat and the ball, wherein the bat speed is a velocity of the bat when contact is initiated between the bat and the ball;

a ball exit velocity radar coupled to the second end of the batting tee configuration that is aligned with the bat speed radar coupled to the first end of the batting tee configuration and fixed at a ball angle that is aligned with a ball exit velocity vector of the ball that is associated with a ball flight of the ball after contact between the bat and the ball and is positioned below the ball flight of the ball a distance from the ball positioned on the first end of the batting tee configuration and configured to measure the ball exit velocity of the ball after contact between the bat and the ball before the ball exit velocity decreases when travelling along the ball flight and does not detect the bat as the bat travels through the ball flight, wherein the ball exit velocity is an exit velocity of the ball early in-flight after contact between the bat and the ball; and an adjustable swing adapter coupled to the batting tee configuration and is configured to adjust the batting tee configuration at an angle that corresponds to an angle of the swing plane of the hitter so that the bat angle of the bat speed radar is aligned with the swing plane of the hitter that is parallel with the angle of the batting tee configuration to measure the bat speed of the bat;

wherein the bat speed radar and the ball exit velocity radar are configured to measure both the bat speed and the ball exit velocity that result from a single swing of the bat in an attempt by the hitter to initiate contact with the ball by the bat as the ball travels along the ball flight that is aligned with the bat speed radar coupled to the first end of the batting tee configuration and the ball exit velocity radar coupled to the second end of the batting tee configuration and transmit both the bat speed and the ball exit velocity to be displayed; and a communications device that includes a display that is configured to simultaneously or sequentially display the bat speed and the ball exit velocity received from the velocity measuring device.

14. The instrumented, angle-adjustable batting tee configuration of claim 13, further comprising:

the adjustable swing angle adapter coupled to the batting tee configuration and configured to adjust the batting tee configuration at an angle that corresponds to an angle of the swing plane so that the ball is positioned in the swing plane and at the angle of the swing plane.

15. The instrumented, angle-adjustable batting tee configuration of claim 13, wherein the bat speed radar includes a Doppler radar and the ball exit velocity radar includes a Doppler radar.

16. The instrumented-angle adjustable batting tee configuration of claim 13, wherein the communications device is further configured to display the bat speed and the ball exit velocity simultaneously.

17. The instrumented-angle adjustable batting tee configuration of claim 13, wherein the communications device is further configured to display the bat speed and the ball exit velocity sequentially.

* * * * *